US007717054B2

(12) United States Patent
Tevlin

(10) Patent No.: US 7,717,054 B2
(45) Date of Patent: May 18, 2010

(54) MOVING MECHANISM FOR CRUISER ARCH

(76) Inventor: Timothy J. Tevlin, 1090 Norell Ave., Stillwater, MN (US) 55082

( * ) Notice: Subject to any disclaimer, the term of this patent is extended or adjusted under 35 U.S.C. 154(b) by 279 days.

(21) Appl. No.: 11/739,382

(22) Filed: Apr. 24, 2007

(65) Prior Publication Data

US 2008/0264325 A1 Oct. 30, 2008

(51) Int. Cl.
*B63B 15/00* (2006.01)
*B63B 17/00* (2006.01)

(52) U.S. Cl. ..... 114/343; 114/364

(58) Field of Classification Search ..... 114/253, 114/254, 343, 361–364; 49/197–206; 160/201–209; 280/756, 763.1–766.1; 296/107.18
See application file for complete search history.

(56) References Cited

U.S. PATENT DOCUMENTS 1,975,013 A * 9/1934 Minnich ..... 100/226
3,179,959 A 4/1965 McDougall
3,370,308 A 2/1968 Krenzler
3,797,436 A 3/1974 Moore
3,800,726 A 4/1974 Murphy
4,694,773 A 9/1987 Sparkes et al.
6,209,477 B1 4/2001 Biedenweg
6,986,321 B2 1/2006 Metcalf
7,159,531 B2 1/2007 Baylor

OTHER PUBLICATIONS

Website page, Gary Voller's Yacht Sales & Brokerage, 31'0" Silverton 310 Express Cruiser, 2 pages.
Website page, Trailer Boats, Arc d' Triumph, 5 pages.

* cited by examiner

*Primary Examiner*—Ajay Vasudeva
(74) *Attorney, Agent, or Firm*—Haugen Law Firm PLLP; Frederick W. Niebuhr

(57) ABSTRACT

A cruiser arch moving and control mechanism includes a pair of carriage guides (32, 150, 188) fixed to opposite sides of a cruiser hull, and a pair of carriages (30, 170), each mounted to one of the opposing legs of the cruiser arch. Each of the carriage guides includes a slot (40, 156, 190) with an elongate linear track section and an adjacent arcuate track section. Each carriage includes a pair of spaced apart bearings (76/78, 164/176, 198/200) that are confined for reciprocal travel along one of the slots to support the carriage moveably relative to the associated carriage guide. Two linear actuators (34), one coupled between each carriage and its associated guide, are extendable and retractable in concert to move the arch between working and clearance positions. The carriage guides are configured to prevent any substantial rotation of the carriages until the arch is extended linearly at least a predetermined distance from the working position.

21 Claims, 8 Drawing Sheets

32
148
44
3
3
122
116
40
42
126
66
124
60
108
112
114
68
146
104
30
56
82
110
118
62
120
130
106
34
132
90
136
140
142
144
134
138
128
137

MOVING MECHANISM FOR CRUISER ARCH

BACKGROUND OF THE INVENTION

The present invention relates to arch or bridge assemblies used in cruisers and other watercraft for supporting radar antennas and other equipment, and more particularly to mechanisms for controlling movement of such assemblies between a generally upright position for use, and a lowered position for stowage, on-land transit or for allowing the watercraft to pass under bridges and other obstructions having low clearance.

For years, cabin cruisers and other watercraft have employed arch-shaped structures for supporting radar antennas, radio antennas and other electronic equipment above the normal deck level. A typical arch assembly includes an opposed pair of generally upright legs secured to the gunwales or elsewhere on opposite sides of the hull, and a transverse bridge member or transom attached to the tops of the legs and spanning the distance between them. Typically, the equipment is mounted to the bridge member.

While effective in supporting antennas and other equipment, the arch assembly increases the need for overhead clearance, whether the cruiser is in use or mounted on a trailer for towing. Stowage can be more difficult, and more expensive in facilities that charge by the cubic foot. While arch assemblies can be mounted in a manner that allows their detachment for the hull when the cruiser encounters a bridge or other overhead obstruction, detachment and reattachment are difficult in view of the weight and bulk of the arch assembly. An arch-shaped structure can be mounted pivotally relative to the gunwales, as shown in U.S. Pat. No. 6,986,321 (Metcalfe) in connection with a wake tower for towing a wake boarder or water skier. This still calls for manual handling, which can be difficult in view of the larger size and weight of arch assemblies as compared to the wake tower shown in Metcalfe.

U.S. Pat. No. 4,694,773 (Sparkes et al.) discloses a power system for raising and lowering an arch assembly. Each lower end of the arch is mounted to pivot relative to the boat through a top cover component and a lower base mounting component. A hydraulic motor within the base component is operable to extend a rod, pivoting a bracket to raise the arch. The arch can be lowered by allowing it to descend by gravity. The rod retracts, dampened by the hydraulic motor cylinder.

While this approach is effective from the standpoint of powering the arch assembly, it requires a bulky, unsightly housing at the base of each leg, along with an exposed pivotal coupling between separate components of the mechanism. In a competitive marketing environment where aesthetic appeal carries considerable weight, the arch assembly typically is treated as a feature of the cruiser design, either to blend in with the rest of the vessel or create its own impact on the overall appearance. Thus, the functional utility of any conventional arch assembly control mechanism is countered by the unwanted alteration in the appearance of the arch, the watercraft hull near the arch, or both. Accordingly, the present invention has several aspects directed to one or more of the following objects:

to provide a system for raising and lowering an arch assembly of a watercraft through linkage and motive components that are recessed into the arch assembly or hull, and are hidden from view when the arch assembly is in the generally upright working position;

to provide a linkage between a watercraft hull and an arch assembly adapted to guide the arch assembly through a controlled sequence and combination of linear travel and rotation as the assembly is moved from a generally upright working position to a clearance position;

to provide a linkage coupling an arch assembly for controlled movement relative to a watercraft hull, configured to maintain the arch assembly in a generally upright orientation for linear travel when the arch assembly is within a predetermined distance of the hull, while permitting the arch assembly to rotate relative to the hull when separated from the hull by more than the predetermined distance; and to provide a mechanism for controlling movement of an arch assembly between working and clearance positions relative to a watercraft hull through a linear actuator operable to both linearly translate and pivot the arch assembly.

SUMMARY OF THE INVENTION

To achieve these and other objects, there is provided a linkage for guiding movement of a leg of an arch assembly between a raised working position and a lowered clearance position. The linkage includes a guide member adapted for mounting with respect to a watercraft hull and shaped to provide a guide track having a substantially linear first track section and an adjacent arcuate second track section. The linkage includes a carriage adapted for mounting to a leg of an arch assembly. First and second spaced-apart coupling elements are mounted to the carriage and contained for reciprocal movement along the guide track to support the carriage for alternative extension and retraction, between a retracted position corresponding to a raised arch assembly in which the coupling elements are disposed along the first track section, and an extended position corresponding to a lowered arch assembly in which the first coupling element is disposed along the second track section. A track length of the first track section is selected to provide for extension of the carriage at least a predetermined distance from the retracted position before the first coupling element reaches the second track section.

During initial extension, the carriage travels linearly in the direction of the first track section and cannot rotate, since both of the coupling elements are riding along the first track section. As the first coupling element (i.e. the leading coupling element during extension) enters the second track section, it travels in an arcuate path as determined by the second track section. While continuing to move linearly in the extension direction, the carriage at this stage also rotates about an axis through the second (trailing) coupling element. This causes the arch assembly leg to pivot from the generally upright working position to the lowered position for clearance.

The predetermined distance, over which only linear, non-rotational carriage travel can occur, is selected to provide for initial pivoting but need not be sufficient to allow complete arch pivoting to the lowered position. The predetermined distance, plus the additional linear travel that coincides with carriage rotation after the leading coupling element enters the second track section, is sufficient to allow the complete tilting of the arch assembly leg. If desired, the guide track and spacing between the coupling elements can be configured to provide a linear, non-rotational extension that completely clears the leg or tilting to the lowered position.

In any event, the initial non-rotational linear travel avoids the need to locate the leg/hull pivotal connection between the leg and hull outside of the leg and hull, for example as shown in the aforementioned Sparkes patent. The pivotal connection can be concealed from view when the leg and corresponding arch assembly are in the upright position for normal use. A further advantage of this arrangement is that the guide member and carriage, likewise, can be hidden from view.

The linkage can include an actuator adapted for mounting with respect to a watercraft hull and having a movable member adapted to be coupled with respect to the carriage. When so mounted, the actuator is operable to extend and retract the carriage. In a highly preferred arrangement, the actuator is a linear actuator aligned to reciprocate the moving member in the direction of the first track section, and the movable member is rotatably mounted to the second coupling element. This improves stability, because the nonmoving part of the actuator can be fixed rather than pivotally mounted. The linear travel of the movable member effects both linear travel and rotation of the carriage.

Another aspect of the present invention is a watercraft arch control system. The system includes a first guide member fixed with respect to a watercraft hull and shaped to provide a first guide track having a substantially linear first track section and an adjacent arcuate second track section, a second guide member fixed with respect to the watercraft hull and shaped to provide a second guide track having a substantially linear third track section and an adjacent arcuate fourth track section. The second guide member is spaced apart transversely from the first guide member and selectively located with respect to the first guide member to place the first and second guide tracks in substantially parallel and aligned relation. A first carriage is fixed with respect to a first leg of an arch assembly, and a second carriage is fixed with respect to a second leg of the arch assembly. First and second spaced apart coupling elements are mounted to the first carriage and contained for reciprocal travel along the first guide track, between a retracted position in which the first and second coupling elements are disposed along the first track section, and an extended position in which the first coupling element is disposed along the second track section. Third and fourth spaced apart coupling elements mounted to the second carriage and contained for reciprocal travel along the second guide track, between a retracted position in which the third and fourth coupling elements are disposed along the third track section, and an extended position in which the third coupling element is disposed along the fourth track section. The first and second carriages are operable in concert to move the arch assembly between a raised arch working position when the first and second carriages are retracted and a lowered arch clearance position when the first and second carriages are extended. A track length of the first and third track sections is selected to provide for extension of each of the first and second carriages at least a predetermined distance from the retracted position before the first and third coupling elements enter the second and fourth track sections, respectively.

Preferably the system further includes first and second actuators mounted with respect to the watercraft hull and having respective first and second movable members coupled with respect to the first and second carriages, respectively. The actuators are operable in concert to move the arch assembly between the raised arch and lowered arch positions. The guide members, carriages, and actuators are advantageously disposed in opposing recesses of the watercraft hull and legs of the arch assembly, and as a result are hidden from view when the arch assembly legs engage the hull in the raised arch position to close the recesses.

Preferably each of the first and second guide tracks comprises an elongate slot that contains its associated coupling elements for reciprocating travel.

Further in preferred embodiments, the second and fourth coupling elements are disposed along the first track section and third track section respectively even when the first and second brackets are in the extended position. In other words, these coupling elements remain within linear track sections, restricted to linear travel. Then, linear actuators can be employed, preferably with their moving members rotatably mounted to the second and fourth coupling elements, to linearly translate and rotate their respective carriages.

Another aspect of the present invention is a system for controlling a cruiser arch. The system includes a coupling mechanism for joining an arch assembly to a watercraft hull for substantially linear travel, while maintaining the arch assembly at a selected working angle, between a working position in which first and second opposite legs of the arch assembly are engaged with the hull, and an intermediate position in which the first and second legs are spaced apart from the hull by at least a predetermined distance. An arch pivoting mechanism, operable only when the legs are spaced apart from the hull by at least the predetermined distance, is adapted to pivot the arch assembly relative to the hull between the selected working angle and a selected clearance angle in which the arch assembly is lowered for overhead clearance.

The preferred coupling mechanism comprises first and second guide members fixed with respect to the hull and shaped to provide respective first and second guide tracks, along with first and second coupling elements mounted with respect to the first and second legs respectively and contained for reciprocal travel along substantially linear sections of the first and second guide tracks, respectively. Then, the pivoting mechanism can comprise third and fourth coupling elements mounted with respect to the first and second legs respectively and contained for reciprocal travel along respective arcuate track sections of the first and second guide tracks.

Thus in accordance with the present invention, linear actuators are employed in concert to move the legs of an arch assembly linearly to separate the arch from the hull of a watercraft, and then to pivot the arch assembly legs from a generally upright angle to a lowered angle for improved overhead clearance. Because the arch assembly is restricted to linear travel initially, there is no need to provide any motive or coupling components outside of the arch assembly profile. This allows these components to be hidden from view when the arch assembly is in its normal upright working position.

IN THE DRAWINGS

For a further understanding of the foregoing and other advantages, reference is made to the following detailed description and to the drawings, in which.

DETAILED DESCRIPTION OF THE PREFERRED EMBODIMENTS

Figure 1:
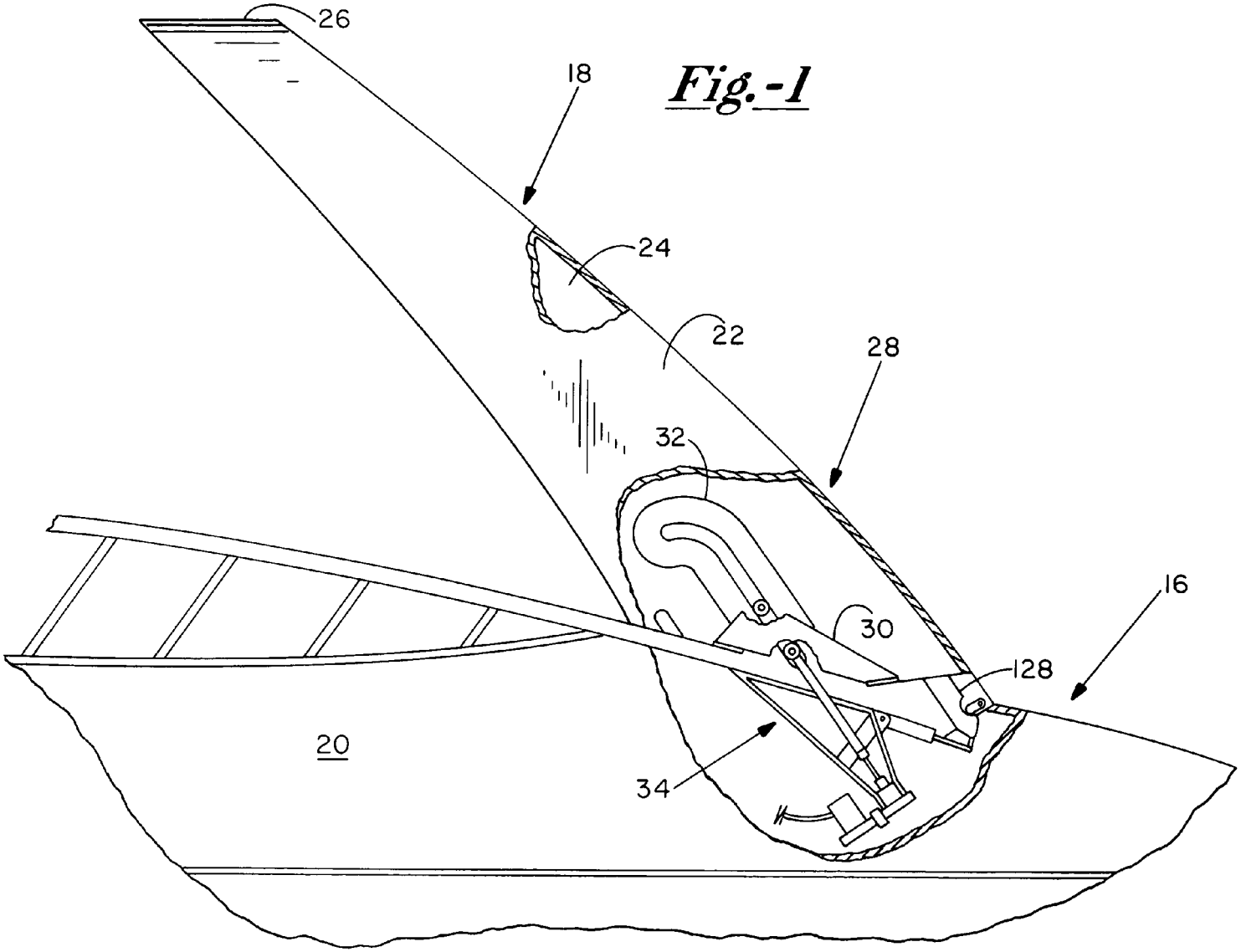
FIG. 1 is a perspective view showing part of a cruiser equipped with a movable arch.
Figure 12:
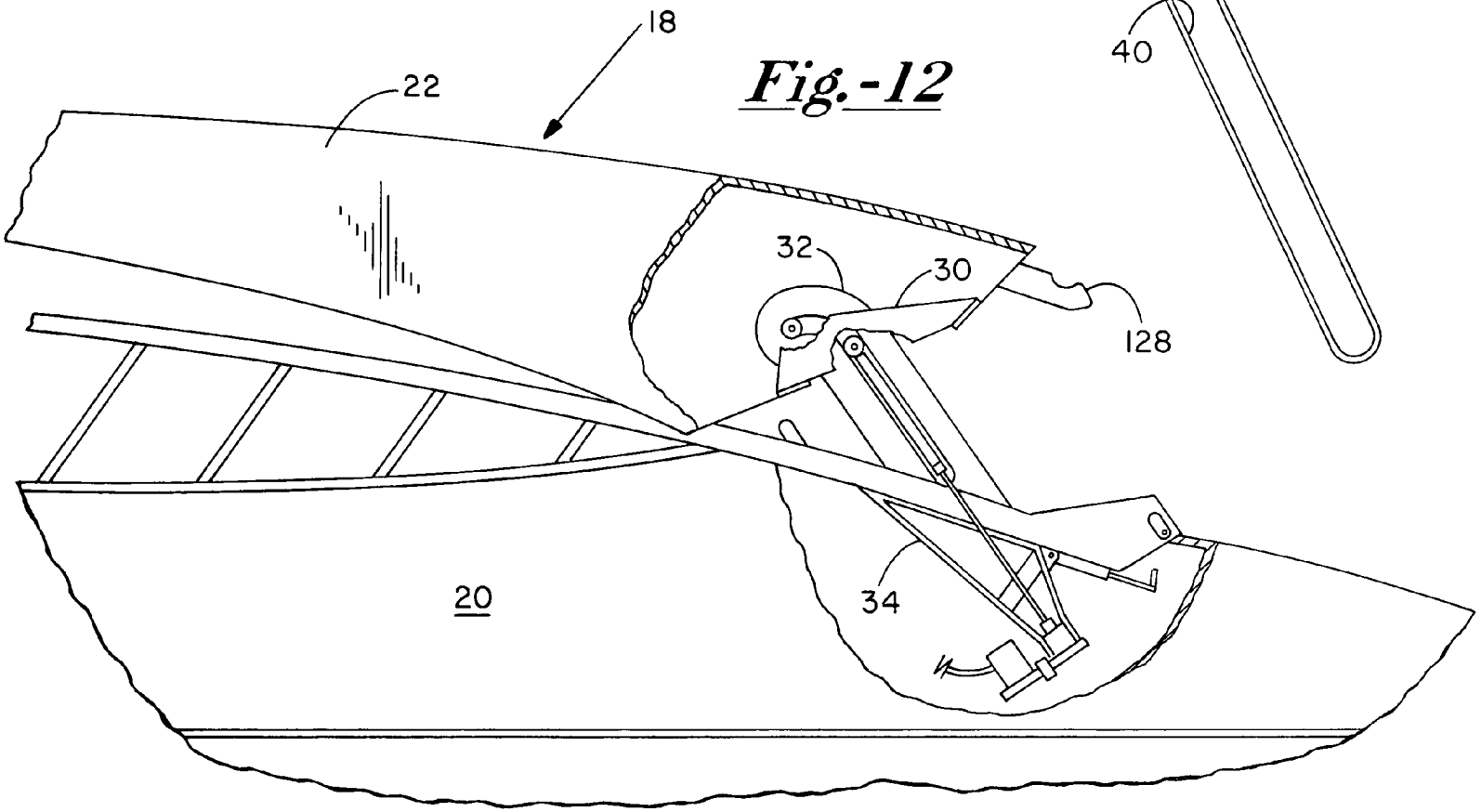
FIG. 12 is a side elevation similar to FIG. 10 illustrating the arch in a lowered position corresponding to the extended position.

Turning now to the drawings, there is shown FIG. 1 a cruiser 16 and a cruiser arch 18 mounted movable to a hull 20 of the cruiser between a working position as shown, and a clearance position (FIG. 12) in which the arch is lowered to provide improved overhead clearance. In the working position, arch 18 supports radar antennas, radio antennas, and other electrical equipment (not shown) for normal use.

Arch 18 includes opposite legs 22 and 24 that are generally upright in the working position, although somewhat forwardly inclined. The opposite legs are joined by a horizontal transom or cross member 26.

Portions of leg 22 and hull 20 near the gunwale are broken away to reveal an arch moving and controlling mechanism 28. Mechanism 28 is housed within recesses formed in leg 22 and hull 20, and thus is concealed from view when arch 18 is in the working position. The major components of mechanism 28 include a carriage 30 integrally mounted to leg 22, a carriage guide 32 mounted integrally to the hull at the gunwale, and a linear actuator 34 mounted to the hull and having a moveable drive member coupled to the carriage.

Figure 2:
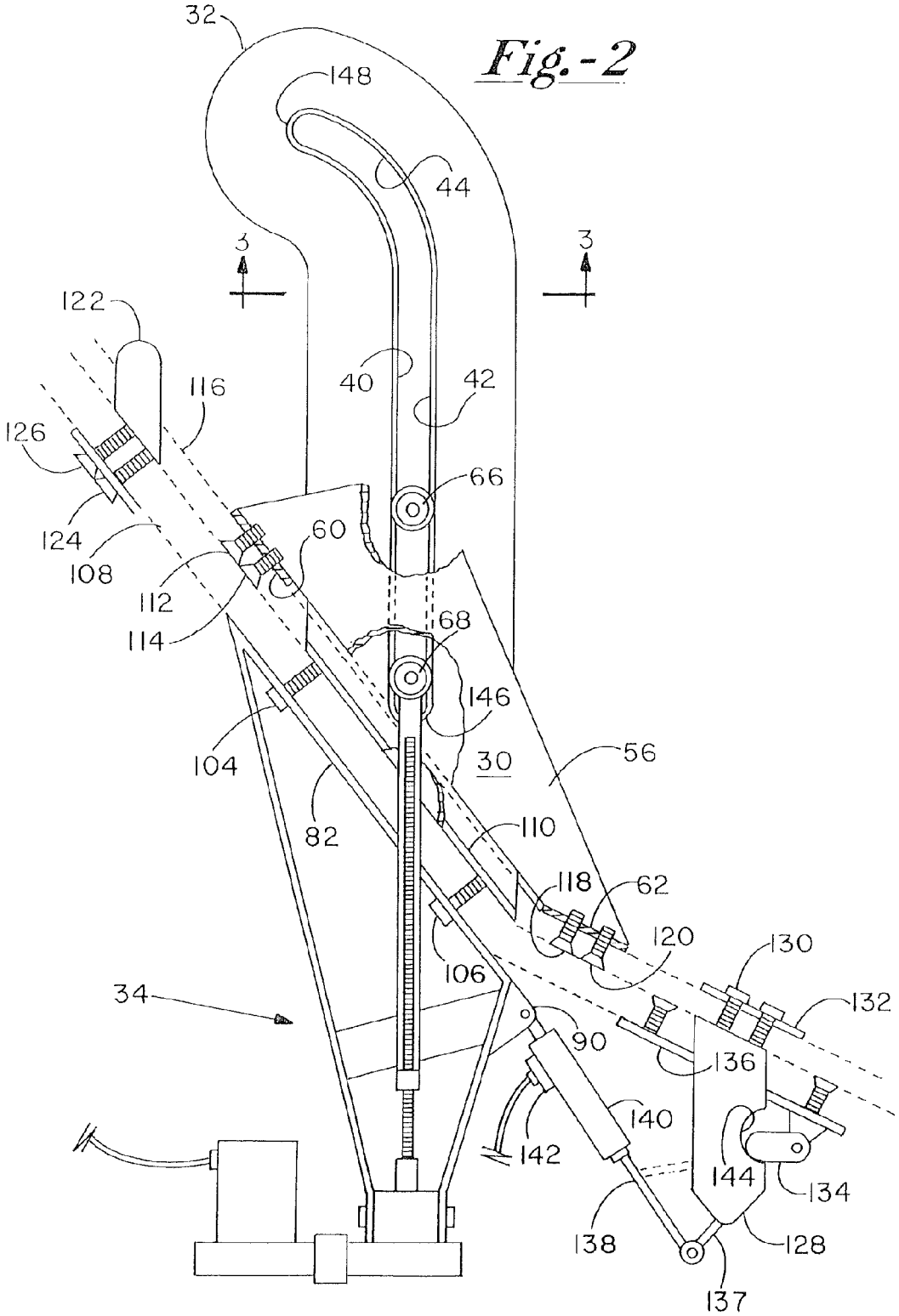
FIG. 2 is a side elevation of an arch moving mechanism constructed in accordance with the present invention.
Figure 3:
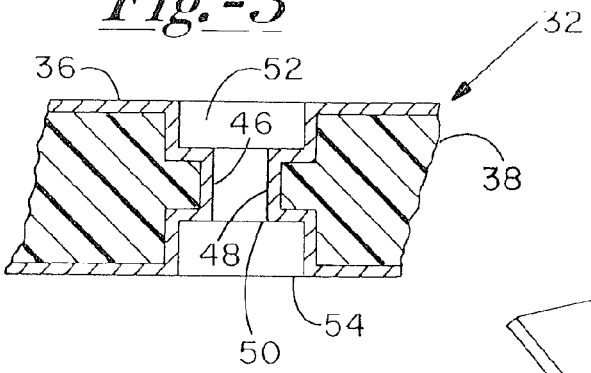
FIG. 3 is a sectional view taken along the line 3-3 in FIG. 2.

As seen from FIGS. 2 and 3, carriage guide 32 has the general shape of an inverted "J" with an outer shell 36 formed of steel, e.g. 3/16 inch steel plate, and a rigid plastic interior 38 surrounded by the shell. A slot 40 is formed through guide 32 to provide a guide track that controls carriage movement relative to the guide. An elongate linear region of the slot provides a linear track section 42, with an adjacent arcuate region providing an arcuate track section 44.

As best seen in FIG. 3, the interior walls of guide 32 have opposed shoulders 46 and 48 to form slot 40 with a relatively narrow central region 50 and two wider opposite side regions 52 and 54.

While the shape and size of carriage guide 32 can vary with the application, a suitable version of the guide has a length of about 20-25 inches, a width of about 6 inches, and a thickness of about 1½ inches.

Figure 4:
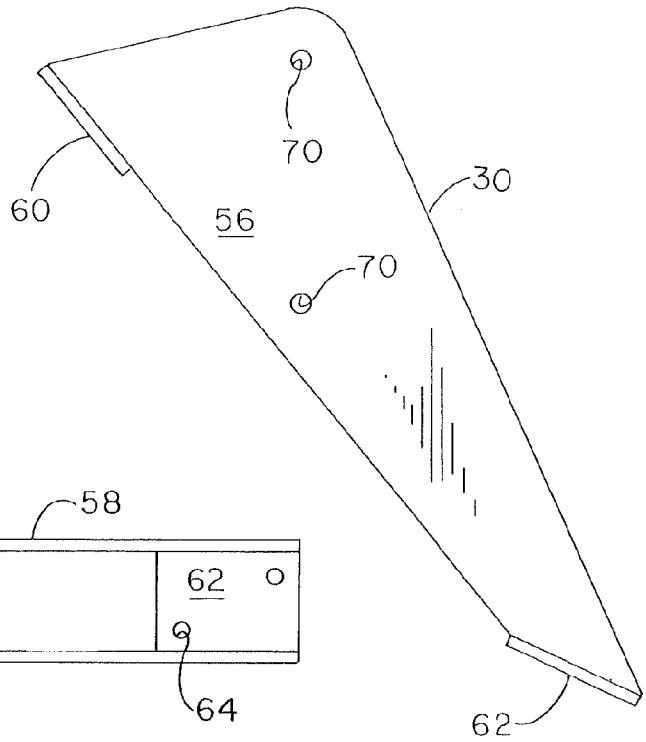
FIG. 4 is a side elevation of a carriage of the moving mechanism.
Figure 5:
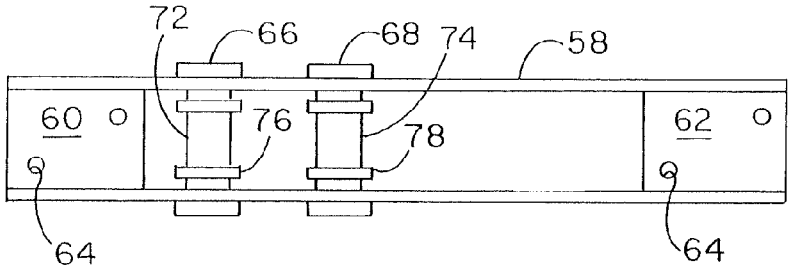
FIG. 5 is a top plan view of the carriage.
Figure 6:
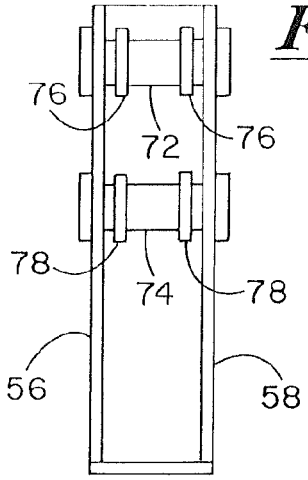
FIG. 6 is an end view of the carriage.

FIGS. 4-6 show carriage 30. A body of the carriage includes opposite side panels 56 and 58, and opposite transverse panels 60 and 62 that couple the side panels and include openings 64 to receive fasteners that secure the carriage body to leg 22. As best seen in FIG. 5, panels 56, 58, 60 and 62 cooperate to form an open space through which guide 32 is received for carriage/guide relative movement.

Further as seen in FIG. 6, the carriage includes two spaced apart bearing assemblies 66 and 68 mounted to side panels 56 and 58 through openings 70 for rotation relative to the side panels. The bearing assemblies further are contained in slot 40 for reciprocal motion relative to guide 32. Respective spacers 72 and 74 are disposed between pairs of bearings 76 and 78 that ride along side regions 52 and 54 of the slot. Spacer 74 also serves as a coupler, as noted below.

Figure 7:
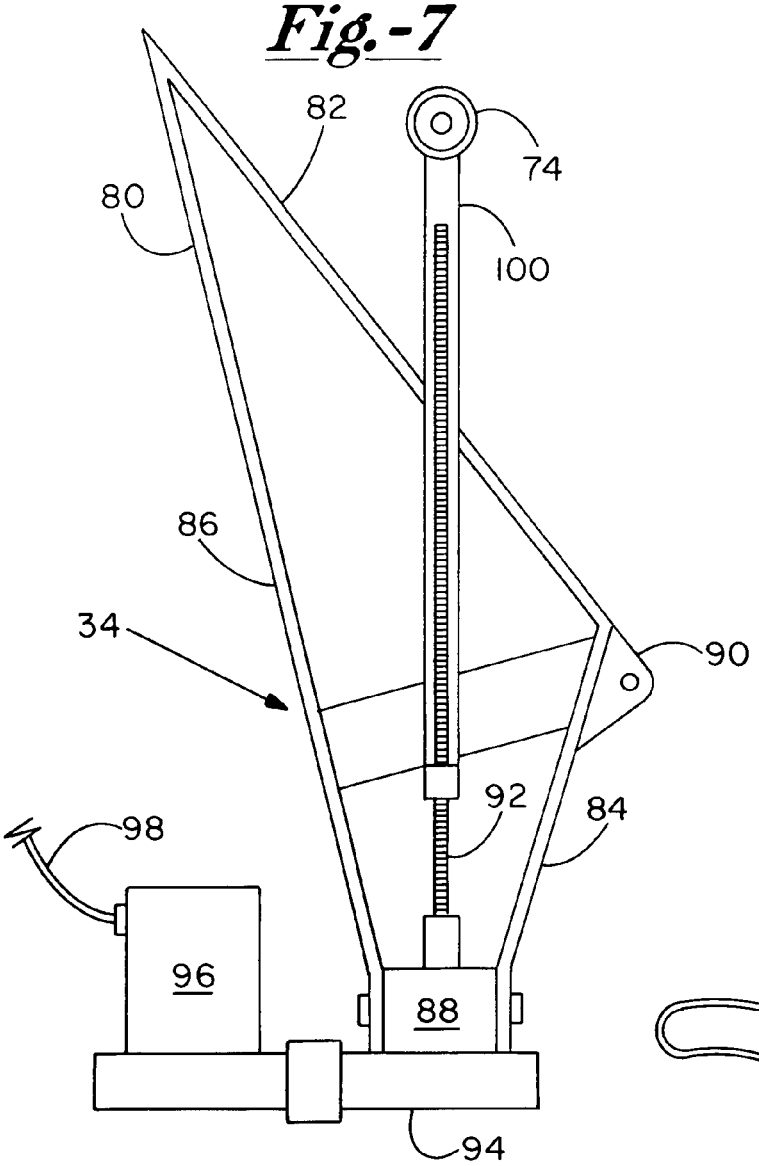
FIG. 7 is a side elevation of an actuator of the moving mechanism.

As seen in FIG. 7, linear actuator 34 includes an actuator support frame 80 having frame members 82, 84, and 86. Frame member 82 is coupled directly to the hull, while frame members 84 and 86 are secured to an actuator drive housing 88 to support the housing. Frame member 84 also supports a bracket 90 used to mount a latching mechanism actuator.

The linear actuator includes an elongate worm 92 rotatable through a drive gear inside drive housing 88. A gear train within a casing 94 associates the drive gear with an electric motor 96. A conductor 98 electrically couples the motor to the cruiser battery or another suitable power supply. A tubular drive member 100 is rotatably coupled to worm 92 for linear travel as the worm rotates.

Figure 8:
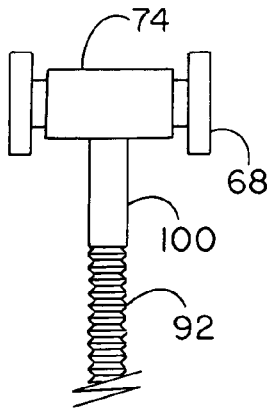
FIG. 8 is an enlarged end view showing a bearing and part of the actuator.

Annular spacer 74 is disposed at the remote end of drive member 100 and is mounted to bearing assembly 68 in surrounding relation to the assembly as seen in FIG. 8. Thus, the linear movement of the drive member moves bearing assembly 68 linearly along track section 42, thus moving carriage 30 relative to carriage guide 32.

With further reference to FIG. 2, the mounting of linear actuator 34 and carriage guide 32 to the cruiser hull is accomplished simultaneously with threaded fasteners 104 and 106 that extend through frame member 82, a gunwale region 108 of the hull (shown in phantom, typically fiberglass) and a bottom panel 110 of shell 36, then into the polymeric interior 38 of the guide. Thus, the carriage guide and the stationary components of the linear actuator are integral with the hull.

The carriage body is mounted integrally to leg 22 by threaded fasteners 112 and 114 extending through a bottom edge region 116 of leg 22 (shown in phantom, typically fiberglass) and panel 60, together with a pair of fasteners 118 and 120 extending through region 116 and panel 62. The incline of panel 62 relative to panel 60 is dictated by the style of the arch, particularly the shape of the leg along its bottom edge. Carriage panels used with other watercraft may well be inclined at different angles, or may be coplanar. In any event, the mechanism is preferably substantially centered within leg 22 and the adjacent region of the hull, with the carriage and carriage guide occupying a recess formed in the leg, and the majority of the linear actuator occupying a recess formed in the hull. When the arch is in the working position shown at FIG. 1, leg 22 is engaged with hull 20, thus to close the recesses and hide the components from view.

An alignment pin 122 is mounted to gunwale region 108 through fasteners 124 and a steel plate 126. The alignment pin extends upwardly into a recess near the forward edge of leg 22 when the leg is in the working position. When the leg is being brought downward toward the working position, the alignment pin is captured by the recess to align the leg as it is brought against the hull.

Near the rearward end of the leg is a latching mechanism including a latching pin 128 mounted to bottom edge region 116 via fasteners 130 extended through a steel plate 132. Latching components mounted to the hull include a latch cam 134 mounted rotatably on a base 136 secured to gunwale region 108. A latch arm 137 is integral with the latch cam, and is coupled to a rod 138 that reciprocates in a cylinder 140 of a latch actuator 142. The cylinder is mounted pivotally on bracket 90.

When extended as shown, rod 138 pivots latch arm 136 and cam 134 to a locking position in which the cam, bearing against latching pin 128 within a detent 144, positively secures leg 22 against the hull. When rod 138 is retracted, the latch arm and latch cam are rotated clockwise until cam 134 no longer resides in detent 144, thus to free leg 22 for extension away from the hull.

A moving mechanism substantially identical to mechanism 28 is mounted within the recesses formed in leg 24 and in hull 20 near leg 24. The mechanisms are operated in concert to control motion of arch 18 between the working and clearance positions.

A salient feature of the control mechanisms is the degree of control over motion of the arch, to effect a desired sequence and combination of linear travel and rotation of legs 22 and 24. In general, arch movement occurs in two stages between three discrete arch positions determined by the location of the carriage bearing assemblies along slot 40.

In FIG. 2, bearing assemblies 66 and 68 are shown in a retracted position. Both of the bearing assemblies are in linear track section 42, with bearing assembly 68 located at or near a lower end 146 of slot 40. The retracted position corresponds to the arch working position shown in FIG. 1.

Figure 9:
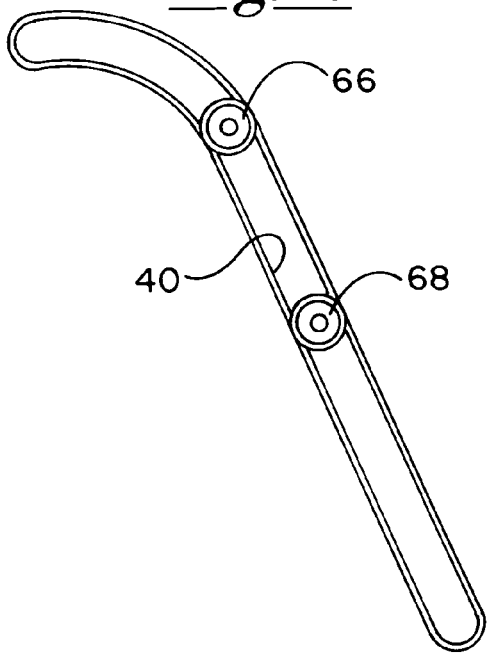
FIG. 9 is a schematic view illustrating an intermediate actuator position.
Figure 10:
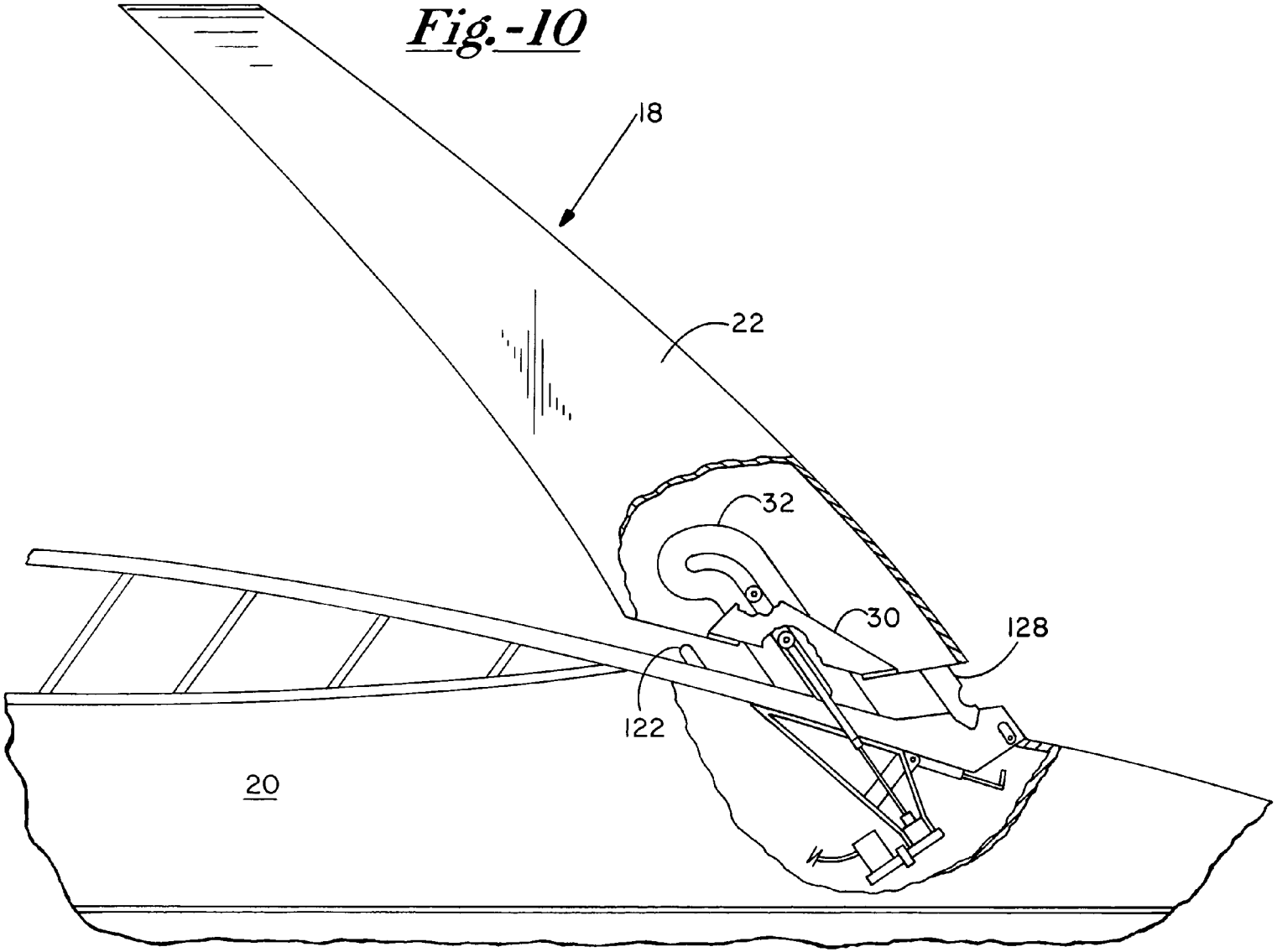
FIG. 10 is a side elevation similar to FIG. 1 illustrating the arch in the corresponding intermediate position.

When the operator of cruiser 16 wishes to lower arch 18 to provide better overhead clearance, he or she first actuates the latching mechanism to release latching pin 128, then operates actuator 34 to extend drive member 100 and thus move the bearing assemblies upwardly and slightly to the left as viewed in FIG. 2. This moves carriage 30 linearly as well. Bearing assembly 66, captured within slot 40, counteracts any tendency of the carriage to rotate about bearing assembly 68. Accordingly the angle of carriage 30 remains constant during this stage of carriage travel. Linear travel continues until leading bearing assembly 66 reaches arcuate track section 44, as illustrated in FIG. 9. The "linear only" travel of carriage 30 and its associated carriage in leg 24 moves arch 18 to an intermediate position illustrated in FIG. 10.

Figure 11:
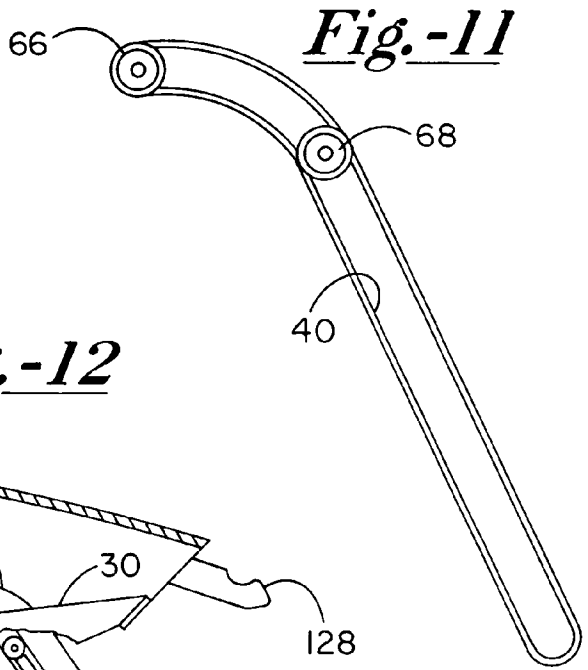
FIG. 11 is a schematic view illustrating an extended actuator position.

As extension of drive member 100 continues, lead bearing assembly 66 moves in the arcuate path determined by arcuate track section 44. As a result, carriage 30 continues to move linearly but also rotates in the counterclockwise direction as viewed in FIG. 2. The combined linear travel and rotation continue until lead bearing assembly 66 reaches or is proximate to an upper end 148 of slot 40 as illustrated in FIG. 11. This corresponds to the lowered arch position shown in FIG. 12. Thus, the stage of motion between the intermediate and lowered arch positions is a combination of linear travel and rotation of legs 22 and 24. The fully extended position of the bearing assemblies and the carriage corresponds to the lowered arch position.

After clearing the overhead obstruction, the operator returns arch 18 to the working position by rotating worm 92 in the opposite direction to retract bearing assembly 66 and the carriage. As it returns from the lowered position to the intermediate position, arch 18 is rotated back to the generally upright working angle, then is moved linearly back into engagement with hull 20. At that stage, the latching mechanism is operated to secure latching pin 128.

It can be appreciated that the linear actuator and latching mechanism could be operated independently if desired. In the preferred approach, they are coupled by a single operating program, to be effected in the required sequence by a single step, e.g. throwing a switch or pressing a button.

The spacing between bearing assemblies 66 and 68, the length of linear track section 42, and the length and radius of arcuate track segment 44 can be varied to achieve optimal performance with cruisers of different designs. In all cases, the bearing assembly spacing and linear track section length cooperate to determine a selected or predetermined distance over which the carriages, and thus the legs of the arch assembly, travel linearly from the retracted position before they are caused to pivot. Preferably the predetermined distance is selected to avoid any unnecessary or excess amount of linear travel. To this end, in the course of lowering the arch, the arch can begin to pivot well before reaching the amount of linear travel necessary to provide full clearance for tilting the arch to the position shown in FIG. 12. This is because linear travel continues after the arch begins to pivot, so that the arch, even if not sufficiently linearly cleared when rotation begins, is cleared by the time the arch is lowered.

The predetermined distance varies with a number of factors, including the size of the boat and shape of the hull, the width of each leg of the arch, and the angle of the arch (relative to the horizontal) when in the working position. For cruiser 16, in which the working angle of arch 18 is about 65 degrees, a suitable predetermined distance is about 10 inches. If the working angle were increased to about 90 degrees in an otherwise similar cruiser and arch, the predetermined distance also would increase, e.g. to about 15 inches.

Slot 40 preferably is configured so that arcuate section 44 encompasses an angle of less than 90 degrees, and more preferably less than 60 degrees. In any event, the remote end of the arcuate section and the track apex should coincide, to avoid the need to generate a lifting force in order to retract the carriage. In most cruiser designs, this restriction presents no difficulty. First, due to the forward incline of many of the arch designs, lowering the arch for clearance requires pivoting over an arc in a range of only 30-45 degrees. Secondly, a given requirement for arch rotation does not translate into a corresponding requirement for the same arc in the arcuate track section, since carriage rotation depends on the spacing between bearing assemblies as well as the shape of the arcuate track segment.

Figure 13:
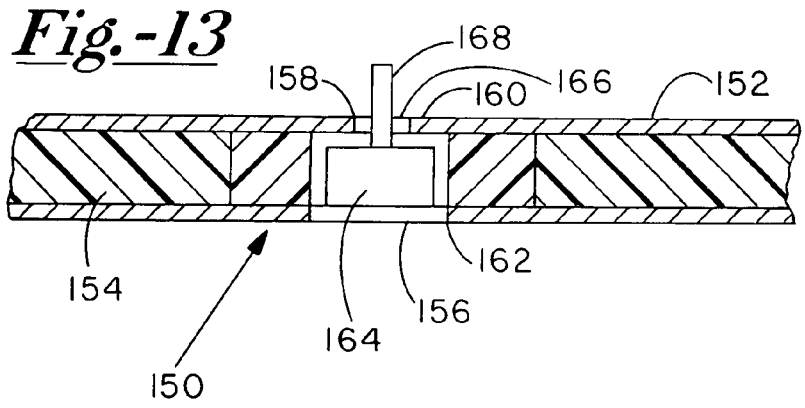
FIG. 13 is a sectional view showing a guide of an alternative embodiment arch moving mechanism.

FIG. 13 is a sectional view, similar to FIG. 3, showing an alternative embodiment carriage guide 150 which, when viewed in side elevation as in FIG. 2, has an appearance similar to carriage guide 32. As before, guide 150 has an outer shell 152 of steel and a polymeric interior 154.

In contrast to slot 40 of carriage guide 32, a slot 156 of carriage guide 150 is defined by interior walls with projections 158 and 160 on one side to form a slot with a single region 162 of larger width to accommodate a bearing 164, and a narrower region 166 to accommodate a shaft 168 that supports bearing 164.

Figure 14:
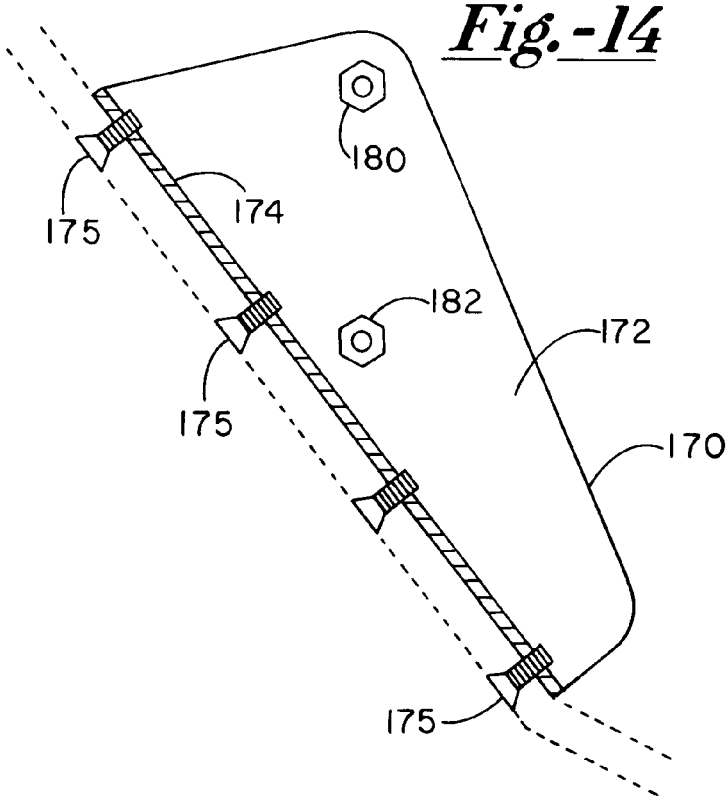
FIG. 14 is a side elevation of an alternative embodiment carriage.
Figure 15:
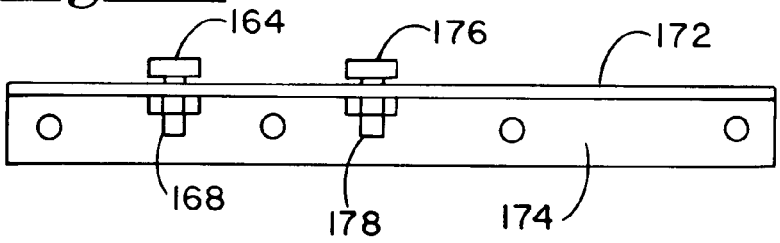
FIG. 15 is a top plan view of the alternative embodiment carriage.
Figure 16:
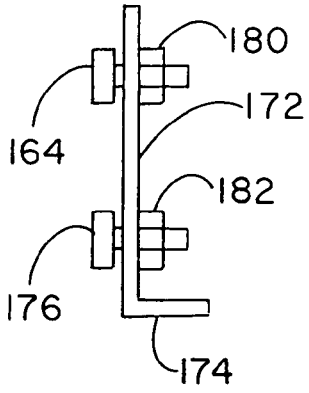
FIG. 16 is an end view of the alternative carriage.

FIGS. 14-16 illustrate an alternative carriage 170 used with guide 150. In this case the carriage body consists of a single upright bearing support panel 172 and a base panel 174 extending from the bottom edge of the bearing support panel. Four threaded fasteners 175 extend through a fiberglass base wall portion of an arch leg and through base panel 174 to secure the carriage body integrally to the leg. Bearings 164 and 176 are mounted rotatably on shafts 168 and 178, respectively, which in turn are secured to panel 172 using nuts 180 and 182.

The primary difference between carriage 170 and carriage 30 is that in the former does not surround the guide and therefore does not provide a symmetrical arrangement. Nonetheless, in many cases this arrangement is preferred, due to the greater ease in securing the arch to the hull using this mechanism.

Figure 17:
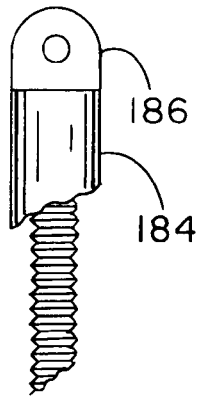
FIG. 17 is an end view showing an alternative embodiment coupling of an actuator to a bearing.

Another difference is the manner in which the free end of a linear actuator drive member 184 is mounted rotatably to the bearing. As seen in FIG. 17, a bracket 186 at the end of drive member 184 has an aperture for rotatably receiving shaft 178 of bearing 176.

Figure 18:
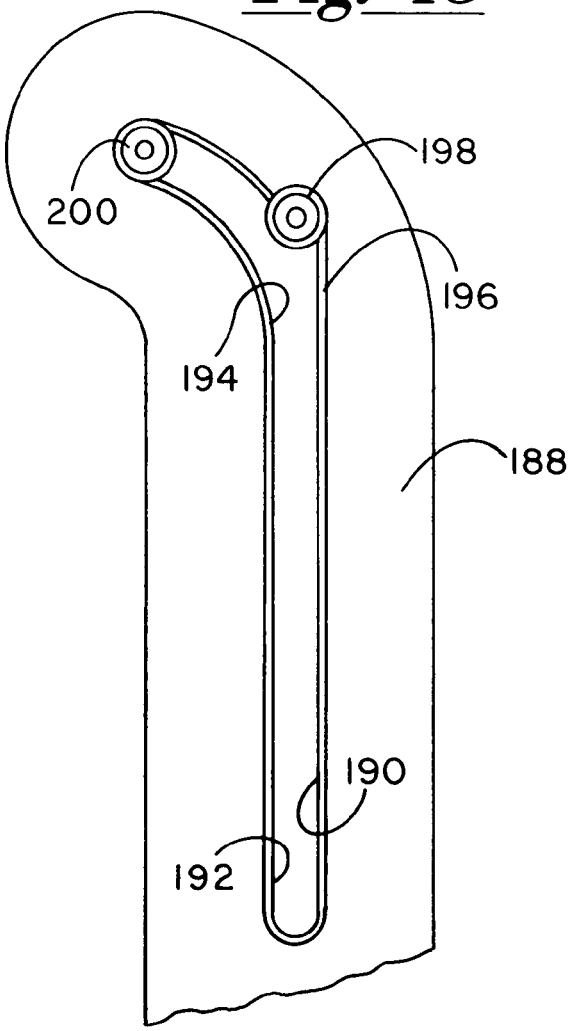
FIG. 18 is a side elevation illustrating an alternative embodiment carriage guide.

FIG. 18 illustrates a further alternative carriage guide 188 similar in construction to guides 32 and 150, with the exception that a slot 190 formed through guide 188 includes not only a linear track section 192 and an arcuate track section 194 as before, but further has an additional linear extension feature 196 designed to allow a trailing bearing 198 to undergo further linear travel after it enters arcuate section 194 to the position illustrated in solid lines. As compared to the guides without feature 196, this arrangement permits further arcuate travel of a lead bearing 200 and further linear extension of trailing bearing 198. The additional travel of both bearings causes additional counterclockwise rotation of the carriage. As before, the carriage is moved through a first stage of only linear travel followed by a second stage that combines linear travel with rotation, effected solely by linear travel of the actuator drive member acting through the trailing bearing.

The use of feature 196 is enabled and facilitated by the distribution of the arch weight, specifically by the forward incline through which the arch weight tends to rotate the arch counterclockwise as viewed in the figure. Forces due to the weight distribution are resolved in a downward force through bearing 200 against carriage guide 188 and an upward force through bearing 198 against the guide. Thus, when lead bearing 200 enters arcuate track section 194 during extension, it tends to stay in the arcuate section and travels to the fully extended position as shown. In contrast, as trailing bearing 198 approaches arcuate section 194 during extension, it tends to enter feature 196 rather than following the arc.

Thus, a carriage guide incorporating feature 196, similar in size to another guide, can allow more rotation of the carriage and thus the arch.

More generally, cruiser arch moving mechanisms configured in accordance with the present invention cause the arches to move according to a controlled sequence and combination of linear travel and rotation relative to the cruiser hull as the arches are moved between generally upright working positions and lowered positions for clearance. An aspect of the sequence is the requirement for a predetermined amount of linear travel away from the working position before the arch is pivoted. This feature enables a recessed mounting of the motive and guiding components whereby they are hidden from view when the arch is in its working position.

What is claimed is:

1. A linkage for guiding movement of a watercraft arch assembly between a raised position for use and lowered position for clearance, the linkage including:

a first guide member mounted with respect to a watercraft hull and shaped to provide a first guide track having a substantially linear first track section and an adjacent arcuate second track section;

a first carriage mounted to a first leg of an arch assembly;

a second guide member mounted with respect to the watercraft hull and shaped to provide a second guide track having a substantially linear third track section and an adjacent arcuate fourth track section, and a second carriage mounted to a second leg of the arch assembly;

first and second spaced-apart coupling elements mounted to the first carriage and contained for reciprocal movement along the first guide track to support the first carriage for alternative extension and retraction, between a retracted position corresponding to a raised arch assembly in which the first and second coupling elements are disposed along the first track section, and an extended position corresponding to a lowered arch assembly in which the first coupling element is disposed along the second track section; and third and fourth spaced-apart coupling elements mounted to the second carriage and contained for reciprocal movement along the second guide track to support the second carriage for alternative extension and retraction between the retracted position in which the third and fourth coupling elements are disposed along the third track section, and the extended position in which the third coupling element is disposed along the fourth track section;

wherein a track length of the first track section and a substantially equal track length of the third track section are selected to provide for substantially simultaneous extension of the first and second carriages at least a predetermined distance from the retracted position before the first and third coupling elements reach the second and fourth track sections, respectively the arch assembly pivoting in a vertical plane between the retracted position in which the legs of the arch assembly are engaged with the hull, and the extended position in which the legs of the arch assembly are spaced apart from the hull.

2. The linkage of claim 1 wherein:

each of the guide tracks comprises an elongate slot, and the coupling elements associated with each guide track are contained in the associated slot for reciprocating travel.

3. The linkage of claim 1 wherein:

the coupling elements are mounted rotatably with respect to the associated carriage.

4. The linkage of claim 3 wherein:

each of the first and second carriages comprises a substantially planar panel, and the associated coupling elements are mounted with respect to the panel for rotation about axes perpendicular to the panel.

5. The linkage of claim 1 wherein:

each of the first and second carriages comprises first and second panels maintained in substantially parallel and spaced-apart relation, with the associated coupling elements joined to and disposed between the panels.

6. The linkage of claim 1 wherein:

the second and fourth coupling elements are disposed along the first and third track sections, respectively when the carriages are in the extended position.

7. The linkage of claim 1 further including:

first and second actuators adapted for mounting with respect to a watercraft hull and having a respective moveable members adapted to be coupled with respect to the first and second carriages, respectively, whereby the actuators are operable to extend and retract the carriages.

8. The linkage of claim 7 wherein:

each of the actuators comprises a linear actuator, and each moveable member is coupled rotatably with respect to an associated one of the second and fourth coupling elements.

9. The linkage of claim 8 wherein:

each moveable member comprises an elongate worm rotatable on a worm axis, and a sleeve engaged with the worm and adapted for axial travel as the worm rotates.

10. The linkage of claim 7 wherein:

each guide member and its associated carriage and actuator are disposed in opposing recesses of a watercraft hull and their associated leg of the arch assembly, and thereby are hidden from view when the legs are disposed against the hull in a raised arch position to close the recesses.

11. The linkage of claim 1 further including:

a latching mechanism adapted for securing each leg of the arch assembly in a raised position with respect to the watercraft hull.

12. A watercraft arch control system, including:

a first guide member fixed with respect to a watercraft hull and shaped to provide a first guide track having a substantially linear first track section and an adjacent arcuate second track section;

a second guide member fixed with respect to the watercraft hull and shaped to provide a second guide track having a substantially linear third track section and an adjacent arcuate fourth track section, wherein the second guide member is spaced apart transversely from the first guide member and selectively located with respect to the first guide member to place the first and second guide tracks in substantially parallel and aligned relation;

a first carriage fixed with respect to a first leg of an arch assembly;

a second carriage fixed with respect to a second leg of the arch assembly;

first and second spaced apart coupling elements mounted to the first carriage and contained for reciprocal travel along the first guide track between a retracted position in which the first and second coupling elements are disposed along the first track section, and an extended position in which the first coupling element is disposed along the second track section; and third and fourth spaced apart coupling elements mounted to the second carriage and contained for reciprocal travel along the second guide track between a retracted position in which the third and fourth coupling elements are disposed along the third track section, and an extended position in which the third coupling element is disposed along the fourth track section;

wherein the first and second carriages are operable in concert to move the arch assembly between a raised arch working position when the first and second carriages are retracted and a lowered arch clearance position when the first and second carriages are extended; and wherein a track length of the first and third track sections is selected to provide for extension of each of the first and second carriages at least a predetermined distance from the retracted position before the first and third coupling elements enter the second and fourth track sections, respectively the arch assembly pivoting in a vertical plane between the retracted position in which the legs of the arch assembly are engaged with the hull, and the extended position in which the legs of the arch assembly are spaced apart from the hull.

13. The system of claim 12 further including:

first and second actuators mounted with respect to the watercraft hull and having respective first and second moveable members coupled with respect to the first and second carriages, respectively, whereby the actuators are operable in concert to move the arch assembly between the raised arch and lowered arch positions.

14. The system of claim 13 wherein:

the first and second actuators comprise linear actuators, the first moveable member is coupled rotatably with respect to the second coupling element, and the second moveable member is coupled rotatably with respect to the fourth coupling element.

15. The system of claim 13 wherein:

the guide members, carriages, and actuators are disposed in opposing recesses of the watercraft hull and legs of the arch assembly and thereby hidden from view when the legs of the arch assembly are engaged with the hull in the raised arch position to close the recesses.

16. The system of claim 12 wherein:

each of the first and second guide tracks comprises an elongate slot, and the coupling elements are contained in their associated slots for reciprocating travel.

17. The system of claim 12 wherein:

the second and fourth coupling elements are disposed along the first track section and third track section respectively when the first and second carriages are in the extended position.

18. A system for controlling a cruiser arch, including:

a coupling mechanism joining an arch assembly to a watercraft hull for substantially linear travel while maintaining the arch assembly at a selected working angle, between a working position in which first and second opposite legs of the arch assembly are engaged with the hull, and an intermediate position in which the first and second legs are spaced apart from the hull by at least a predetermined distance;

wherein the coupling mechanism comprises first and second guide members fixed with respect to the hull and shaped to provide respective first and second guide tracks, and first and second coupling elements mounted with respect to the first and second legs, respectively and contained for reciprocal travel along substantially linear sections of the first and second guide tracks, respectively;

an arch pivoting mechanism, operable only when said legs are spaced apart from the hull by at least the predetermined distance, to pivot the arch assembly relative to the hull in a vertical plane between the selected working angle and a selected clearance angle in which the arch assembly is lowered for overhead clearance.

19. The system of claim 18 wherein:

the arch pivoting mechanism comprises a first guiding element mounted with respect to the first leg, disposed in spaced apart relation to the first coupling element, and contained for reciprocal travel along the first guide track including an arcuate track section thereof; and a second guiding element mounted with respect to the second leg, disposed in spaced apart relation to the second coupling element, and contained for reciprocal travel along the second guide track including an arcuate track section thereof.

20. The system of claim 18 further including:

a first actuator mounted with respect to the hull and having a first moveable member mounted with respect to the first leg, and a second actuator mounted with respect to the hull and having a second moveable member mounted with respect to the second leg, said actuators being operable in concert to reciprocate the first and second coupling elements along the substantially linear track sections of the first and second guide tracks, respectively.

21. The system of claim 20 wherein:

the first and second moveable members are mounted rotatably to the first and second coupling elements, respectively.

* * * * *